US005337657A

United States Patent [19]

Diffrient

[11] Patent Number: 5,337,657

[45] Date of Patent: Aug. 16, 1994

[54] COMPUTER TRAINING AND SUPPORT TABLE SYSTEM

[75] Inventor: Niels Diffrient, Ridgefield, Conn.

[73] Assignee: Howe Furniture Corporation, Trumbull, Conn.

[21] Appl. No.: 891,724

[22] Filed: Jun. 1, 1992

[51] Int. Cl.[5] ..... A47B 3/00

[52] U.S. Cl. ..... 108/115; 108/50

[58] Field of Search ..... 108/115, 50, 64, 124, 108/123, 128, 132

[56] References Cited

U.S. PATENT DOCUMENTS

| | | | |
|---|---|---|---|
| 489,369 | 1/1893 | Case | 108/124 |
| 2,836,475 | 5/1958 | Sapp | 108/64 |
| 3,805,710 | 4/1974 | Leshem | 108/124 X |
| 4,099,469 | 7/1978 | Sahli | 108/115 X |
| 4,748,913 | 6/1988 | Favaretto et al. | 108/50 |
| 4,879,955 | 11/1989 | Moll et al. | 108/50 |
| 4,884,513 | 12/1989 | Newhouse et al. | 108/50 |
| 5,094,174 | 3/1992 | Grund et al. | 108/50 |
| 5,144,888 | 9/1992 | Heine et al. | 108/64 |
| 5,205,223 | 4/1993 | Ball et al. | 108/115 X |

*Primary Examiner*—Jose V. Chen

*Attorney, Agent, or Firm*—Parmelee, Bollinger & Bramblett

[57] ABSTRACT

A folding table system is designed primarily for use with computers and in computer training. It includes tables that are readily folded for storage and unfolded for use. The tables include a variety of optional wire storage capabilities and are so designed that they may be interconnected with one another and with bridging elements and storage devices. Accordingly, a customized arrangement may be readily assembled from a selection of standardized components.

12 Claims, 6 Drawing Sheets

COMPUTER TRAINING AND SUPPORT TABLE SYSTEM

TECHNICAL FIELD

This invention relates to folding tables. More particularly, it relates to folding tables specially adapted for use with computers and in the computer training of personnel.

BACKGROUND ART

While folding tables, per se, are well known in the art, few have been developed which are specifically adapted for computers and, more particularly, to computer training. Tables for such applications should not only be readily foldable for storage, but should also be provided with wireways and means for connecting the tables and wireways into a composite assembly. Such an arrangement would permit an instructor, for example, to employ a master computer connected to a plurality of slaved work stations operated by students.

Accordingly, it is a primary object of the present invention to provide such a composite assembly of individually foldable tables. Other objects, features and advantages will become apparent from the following description and appended claims.

DISCLOSURE OF INVENTION

The present invention comprises a basic table unit of the gate-leg type. The basic table employs a pair of legs which fold into a compact storage position and are easily latched and unlatched by one hand. Furthermore, the two legs are identical in construction, thereby reducing the required parts inventory, leading to economy of construction. The tables include wireways and wire managers, table interconnecting clamps, bridges permitting the connection of tables at angles to one another, and storage means selectively connectable to the tables.

BEST MODE FOR CARRYING OUT THE INVENTION

Basic Table

Figure 1:
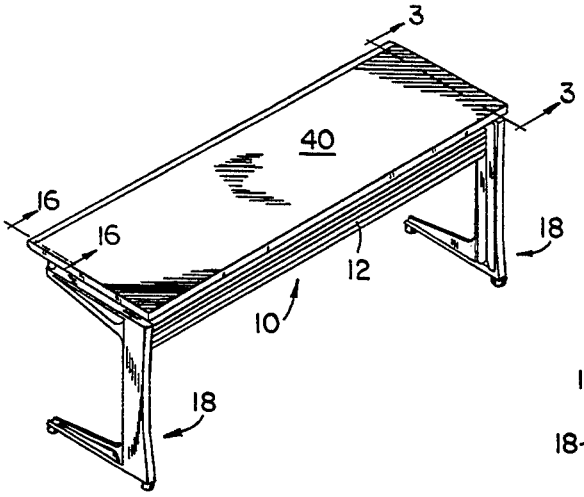
FIG. 1 is a perspective view of a table in accordance with this invention.

Referring particularly to FIGS. 1–3 and 10, the table of the invention comprises a beam 10 in the form of a thin corrugated sheet steel face plate 12 carrying at each end a vertical end plate 14. Mounted to the end plate 14 at each end of the beam 10 is a section of piano hinge 16. The piano hinge 16 is connected to a C-shaped leg member 18.

Figure 5:
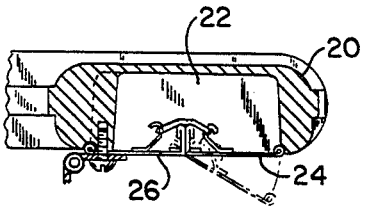
FIG. 5 is an enlarged cross section taken substantially along the line 5—5 of FIG. 4.
Figure 6:
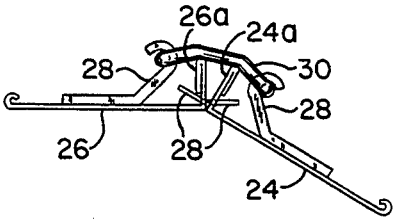
FIG. 6 illustrates the operation of the wiring channel door of FIGS. 4 and 5.
Figure 7:
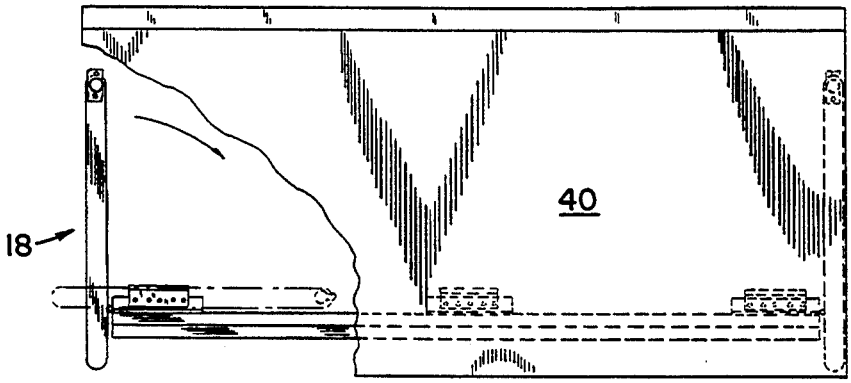
FIG. 7 is a top plan view of the table of FIG. 1, the top being partially broken away to illustrate the construction.

The leg members 18 at each end of the beam 10 are identical but inverted relative to one another. Each comprises a vertical pedestal 20 which is substantially rectangular in cross section to provide a hollow internal wiring channel 22 (FIG. 5). The inner surface of the pedestal 20, as viewed in FIG. 3, includes a half width door 24 enclosing the wiring channel 22. The door 24 abuts a half-width cover 26 over the channel 22. The door 24 and cover 26 hinge together by means of interlocking tabs 28. An inwardly projecting edge **26*a* on cover 26 abuts a similar edge 24*a* on door 24. Hooks 28 on the cover and door are encircled by a rubber band 30 which allows the door 24 to be opened but keeps it normally closed. Cantilevered outwardly from the pedestal 20 are an upper support arm 32 and a leg 34. Mounted to the bottom of each of the legs 34 is a pair of adjustable feet 36**.

Figure 2:
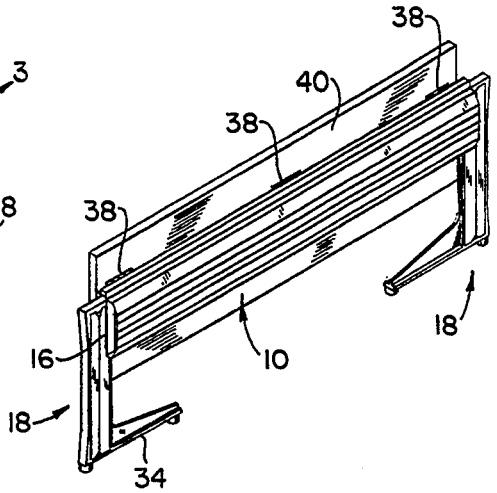
FIG. 2 is a perspective view of the table of FIG. 1 in its folded condition.
Figure 10:
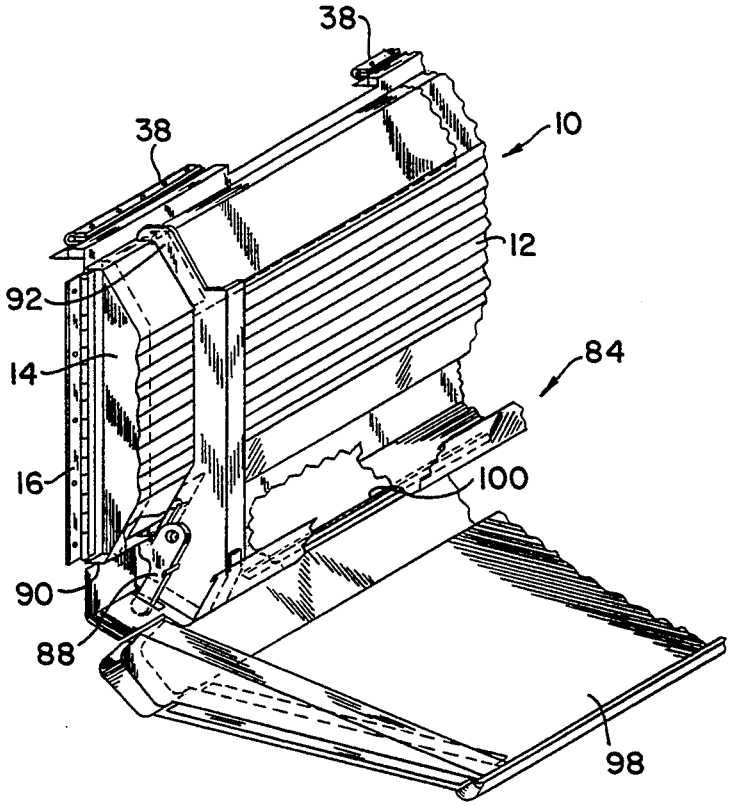
FIG. 10 is an enlarged perspective detail illustrating the assembly of the beam and wire manager.

The top edge of the beam 10 carries lengths of piano hinge 38 along its length and the hinge in turn is secured to the bottom surface of a table top 40 (FIGS. 2 and 10). The table top 40 is substantially rectangular and, as will be seen in FIG. 22, has a honeycomb core 42 covered by surface skins 44 and bounded by edge spars 46.

It will now be seen from what has thus far been described that the individual leg members 18 are hinged relative to the beam 10 so that they may be folded inwardly from their extended positions to folded positions as illustrated in FIG. 2. It will also be apparent that, by virtue of the lengths of piano hinge 38, the table top 40 may also be hinged downwardly to the folded position illustrated in FIG. 2, thereby providing a neat and compact unit for storage.

Figure 16:
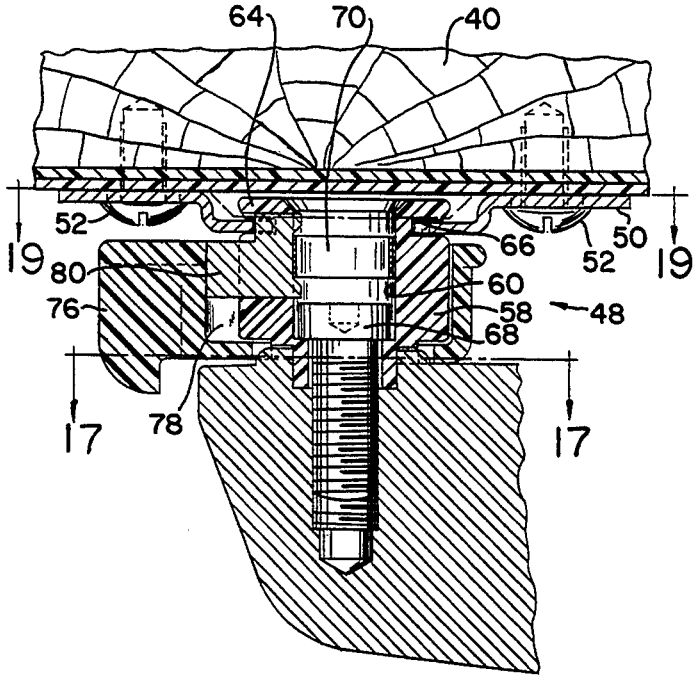
FIG. 16 is an enlarged cross section taken substantially along the line 16—16 of FIG. 1.
Figure 17:
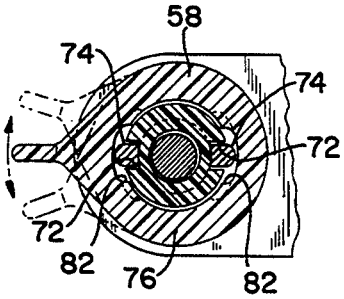
FIG. 17 is a cross section taken substantially along the line 17—17 of FIG. 16.
Figure 19:
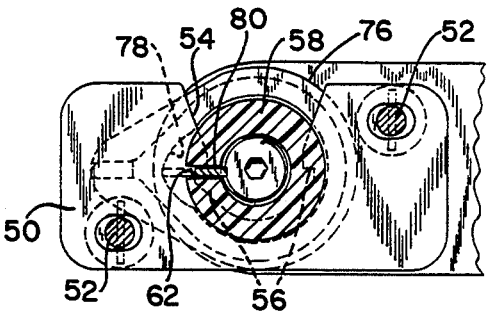
FIG. 19 is a cross section taken substantially along the line 19—19 of FIG. 16.

The table top 40 is secured to the support arms 32 by a latch mechanism 48 (FIG. 16). The latch is characterized by a single knob which releases upon rotation in any direction. The latch mechanism is illustrated most clearly in FIGS. 16, 17, and 19. A latch plate 50 is secured to the table top 40 by means of screws 52. As will be apparent from FIG. 19, the latch plate 50 defines a U-shaped notch 54 which is semi-circular at its base but wider in a direction facing inwardly of the table top. The semi-circular portion of the notch 54 is widened to form a pair of diametrically opposed shoulders 56. Only one of the shoulders 56 is used in each latch, however. This permits the same latch plate 50 to be used for either the right hand or left hand latch member.

A latch post 58 is mounted on each of the support arms 32 for engagement with the notch 54 of latch plate 50. As will be apparent from FIGS. 16 and 19, the latch post 58 is substantially cylindrical and has a dual diameter inner bore 60. A slot 62 in the side of the latch post 58 extends from its bore 60 to its outer surface. The upper end of the latch post 58 includes a disk-like head 64 surmounting a circular slot 66 which mates with the semi-circular portion of the notch 54 in latchplate 50. The latch post 58 is secured to the support arm 32 by a screw 68 which is screwed into support arm 32. Positioned within the bore 60 and above the head of the screw 68 is a lockspring 70 in the form of a cylindrically wrapped leaf. The latch post 58 is prevented from rotating by a pair of recesses 72 on the post which receive a pair of hemispherical bumps 74 on the support arm 32.

Surrounding the latch post 58 for rotation relative thereto is a release lever 76. As will be seen from FIG. 19, the release lever 76 defines an internal V-shaped camming surface 78 which encloses a lock pawl 80 slidably recieved within the slot 62 of the latch post 58. Rotation of the release lever 76 in either direction cams the lock pawl 80 inwardly against the force of lockspring 70 so that it is released from engagement with the shoulder 56. The rotation of release lever 76 is limited by a pair of shoulders 82 on either side of each of the bumps 74 on support arm 32.

Wire Manager

Figure 8:
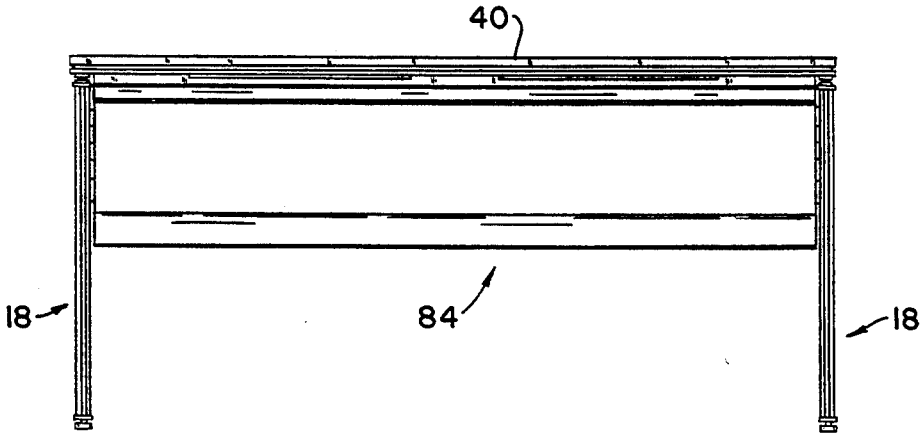
FIG. 8 is a front elevational view of the table of FIG. 7 with a large wire manager installed.
Figure 11:
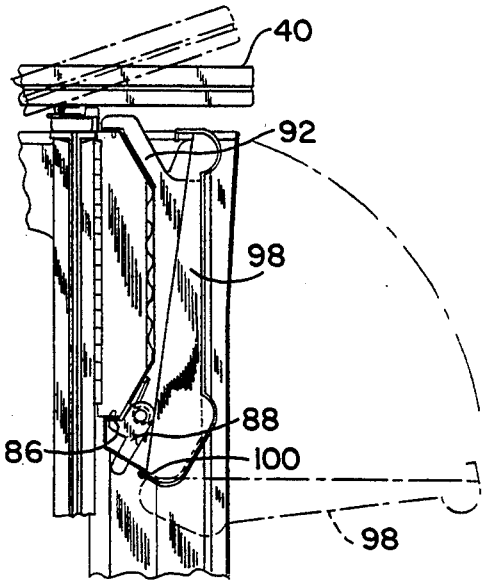
FIG. 11 illustrates the operation of the hinged face of the wire manager.
Figure 12:
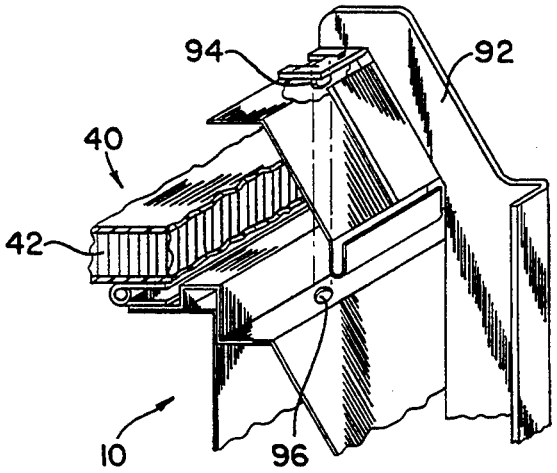
FIG. 12 is a detail showing the relationship between the wire manager and the beam.

In order to increase the wire carrying conduit volume of the table of this invention, a large wire manager 84 may be installed on the beam 10. The large wire manager 84 is in the form of a hinged trough which extends along the length of the beam 10 as shown in FIG. 8. Its construction is best illustrated in FIGS. 10–12. FIG. 10 illustrates the manner in which the wire manager 84 is connected to the beam 10. The edge of the wire manager 84 is in the form of a narrow horizontal shelf 86 (FIG. 11) which has at each end a spring-loaded latch 88. As the wire manager 84 is pushed against the beam 10, the latch 88 is cammed outwardly by the beam and the flat bottom 90 of the beam bears against the shelf 86 of the wire manager. The wire manager 88 also includes at each end a projecting hook member 92 which carries the latch 88. The hook member 92 has an inner surface which conforms to the outer surface of the beam 10. The upper end of each hook member 92 carries a depending tab 94 (FIG. 12) which engages a hole 96 in the top of the beam 10.

Figure 3:
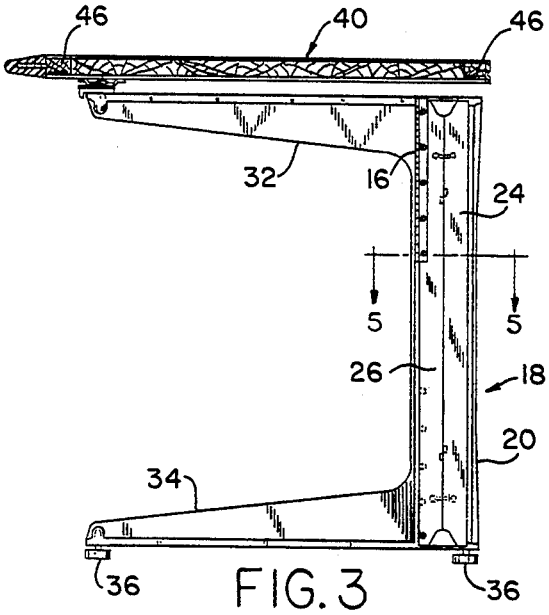
FIG. 3 is an enlarged cross section taken substantially along the line 3—3 of FIG. 1.
Figure 4:
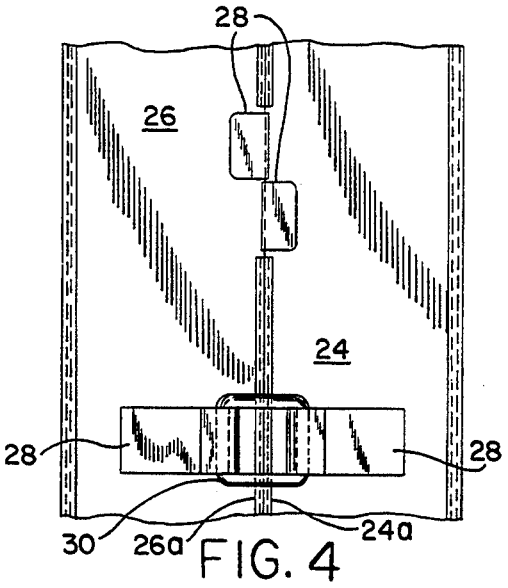
FIG. 4 is an enlarged view of the door of the leg wiring channel, as seen from inside the channel.

The wire manager 84 includes a cover 98 mounted on a piano hinge 100. When the cover 98 is closed, the interior of the wire manager 84 communicates with the interior channel 22 of the leg member 18 via a triangular opening 104 as illustrated in FIGS. 3 and 11.

Gallery Manager

Figure 9:
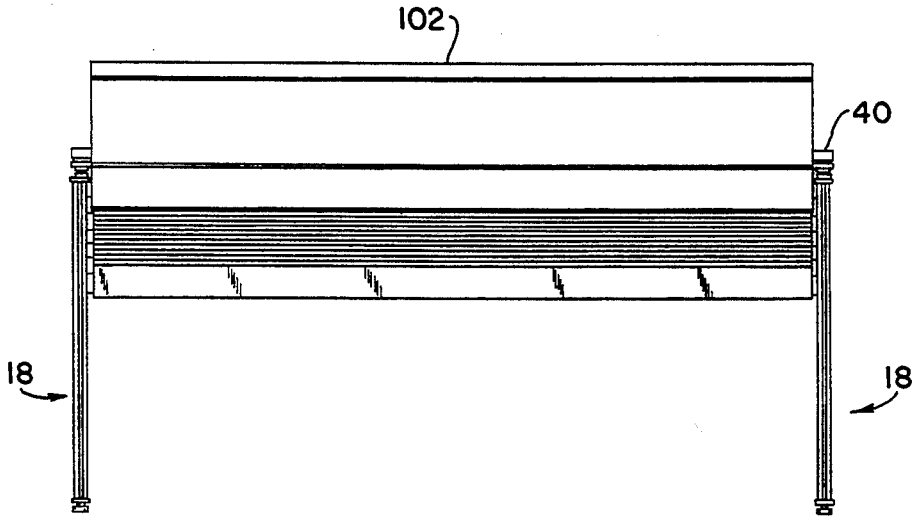
FIG. 9 is a front view of a table similar to that of FIG. 1 having a gallery wire manager installed.

Another accessory which may be used with the basic table of this invention is a gallery wire manager. This accessory provides the dual function of a wire space running the length of the table and a visual shield panel above the top surface of the table to conceal the back of electronic equipment. FIG. 9 illustrates the basic table of this invention with a gallery wire manager 102 in place. As will be clear from FIGS. 13 and 14, the wire-carrying portion of the gallery wire manager 102 comprises an angled backwall 104 which rests against the angled surface of-the beam 10 and a horizontal floor 106. The ends of the trough carry end brackets 108. The end brackets 108 are bent to form outwardly extending flanges 110 which screw into the underside of table top 40.

Figure 13:
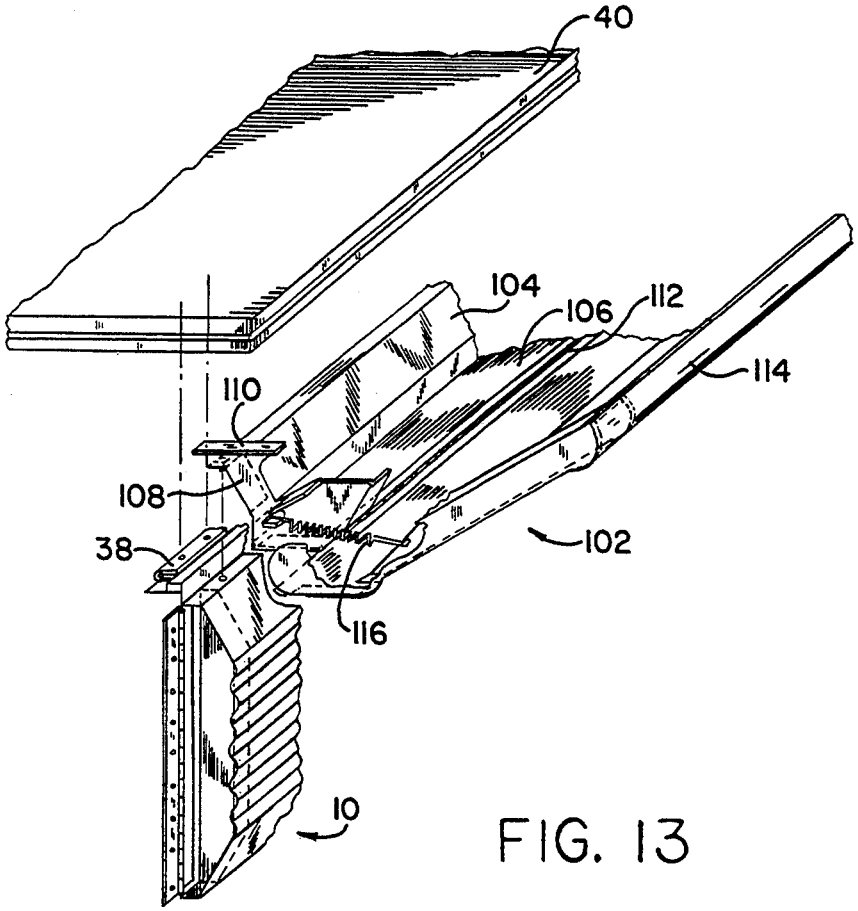
FIG. 13 is an exploded view of the gallery, beam, and table top.
Figure 14:
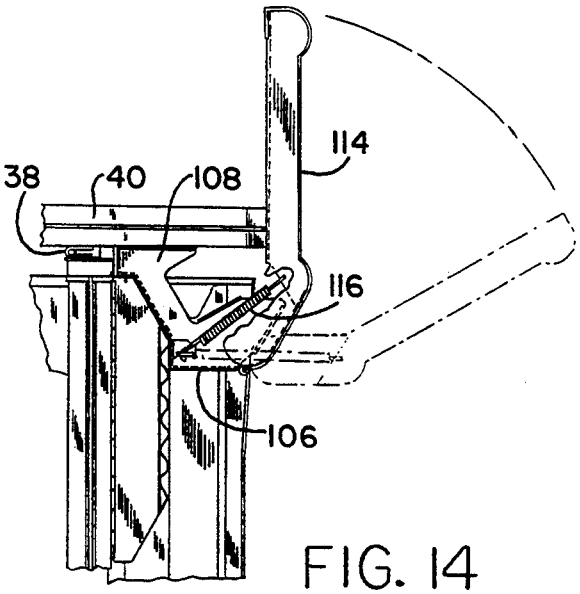
FIG. 14 is an end view of the wire gallery with the right table leg folded.
Figure 15:
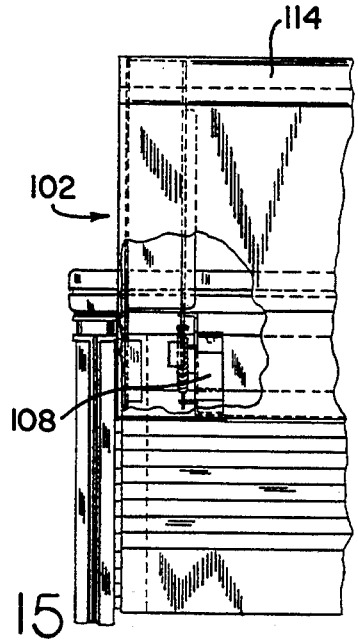
FIG. 15 is a front view of a portion of the table and gallery, a portion of the gallery being broken away.

Extending along the bottom edge of the trough of gallery wire manager 102 is a piano hinge 112. A pivotable shield panel 114, as illustrated in FIGS. 13 and 14, is connected to the piano hinge 112. At each end of the shield panel 114 there is provided a coil spring 116 which tends to maintain the shield panel in its upright position. It may then be readily rotated from its normally closed position as illustrated by solid lines in FIG. 14 to an open position as illustrated by the dash-dotted lines in order to receive wires within the trough as necessary.

Table Connector

Figure 20:
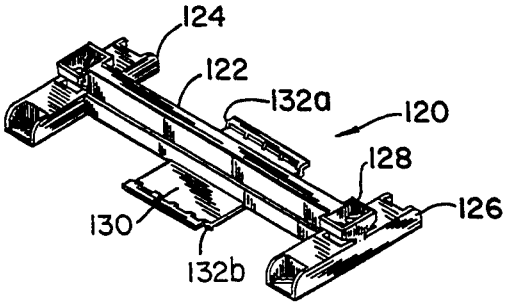
FIG. 20 is a perspective view of a table interconnecting device.
Figure 22:
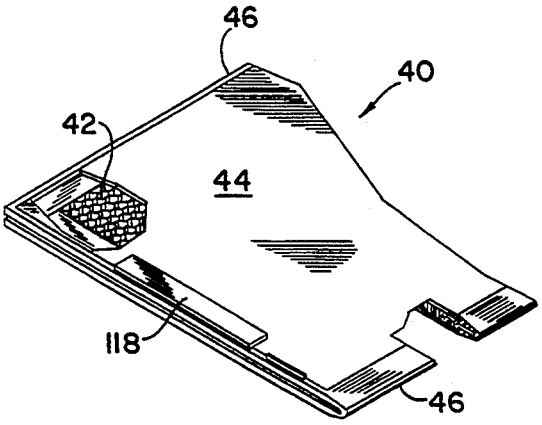
FIG. 22 is a portion of the table top, partially broken away to illustrate its construction.

Secured to the underside of each edge of the table top 40 is a latching strip 118 (FIG. 22). When the table of this invention is in its unfolded position as illustrated in FIG. 1, space exists between each support arm 32 and the table top 40. This space is clearly apparent for example in FIG. 3. This space is utilized to permit the edge to edge connection of tables. The actual connection is effected by a connector 120 as illustrated in FIG. 20.

Figure 23:
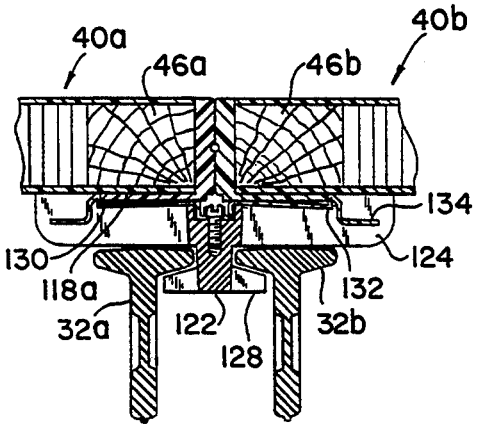
FIG. 23 is an enlarged cross section taken along the line 23—23 of FIG. 24.

FIG. 23 illustrates a pair of table tops **40*a*, 40*b* joined by a connector 120. Each of the table tops 40 includes a depending latching strip 118*a*, 118*b*. Each of the table tops 40 is spaced above the top of the corresponding support arm 32*a*, 32*b***.

The table edge connector 120 will now be described with particular reference to FIGS. 20 and 23. It is formed of plastic and is basically I-shaped having a narrow central portion 122 terminating in widened bases 124, 126. As illustrated in FIG. 20, the connector 120 is shown inverted from its usual condition of use. The bases 124, 126 each includes a flat surface which rests against the undersides of the adjoining table tops **40*a*, 40*b* and their thickness is such as to fill the gaps between the table tops and their respective support arms 32*a*, 32*b*. The underside of the top flange of each support arm is engaged by a depending catch 128**.

A resilient plate 130 extends outwardly on both sides of the central portion 122 of the connector 120. It is formed to overlie the latching strip 118 of a table edge and to engage it with a detent 132 due to its natural resilience. A finger shelf 134 permits disengagement of the table edge.

When a pair of tables are to be joined, the connector 120 is first inserted into the gap between one table top **40*a* and its support arm 32*a*. It is positioned such that the plate 130 is adjacent the aligned latching strips 118. On being so inserted, the detent 13 2*a* of the connector is first depressed by, but then snaps into engagement behind, the latching strip 118***a* as illustrated in FIG. 23. The adjacent table top 36*b* is then moved into position to engage the remaining latch pairs 148*b*, 150*b* which thereupon snap into engagement to combine the table tops as illustrated in FIG. 16. When it is desired to disengage the tables, it is merely necessary to pull on finger shelf 134 allowing the tables to be disengaged and the connector 120 to be removed.

Bridge Connector

Figure 21:
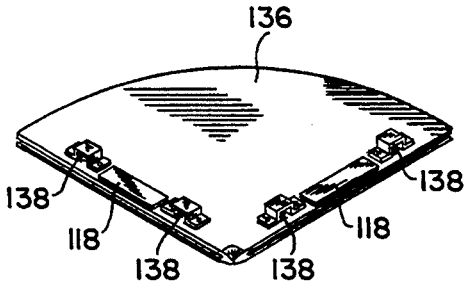
FIG. 21 is a perspective view of the underside of a bridge of this invention.
Figure 24:
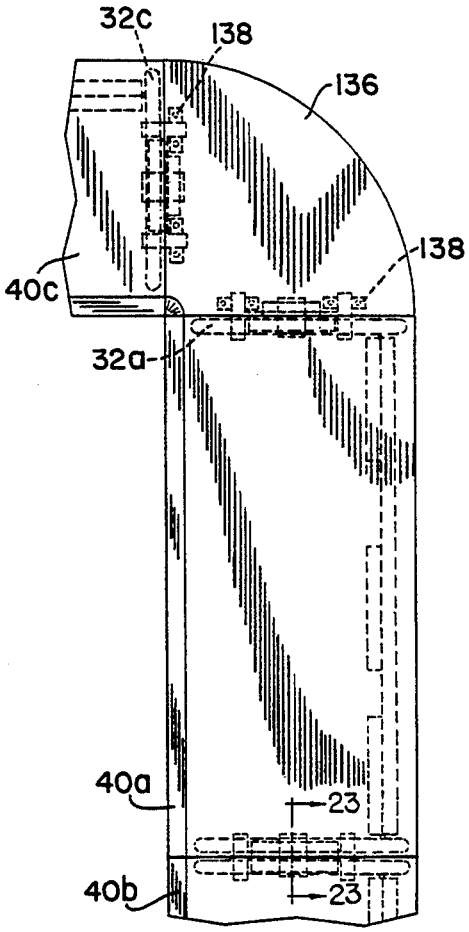
FIG. 24 is a top plan view showing the edges of two rectangular tables joined together and a third table joined by a 90° bridge.

Tables in accordance with this invention may be interconnected by any of a number of differently shaped wedges and bridges. One such arrangement is illustrated in FIG. 24 wherein a table top 40*a* is connected to a table top 40*c* via an intermediate bridge 136 in the shape of a quarter sector of a circle. The interconnecting bridge 136 carries depending latching strips 118 (FIG. 21) which match those of the table tops. Depending from the bridge 136, at either end of each latching strip 118 is a rectangular socket formed from strap loops 138. Each pair of strap loops is spaced to match the spacing between bases 124, 126 of the connector. The connector 120 engages the bridge 136 in the same manner as an adjacent table edge. However, the bases 124, 126 are received within the strap loops 138 rather than in a space defined by the top of a support arm.

Accessory Cart

Figure 18:
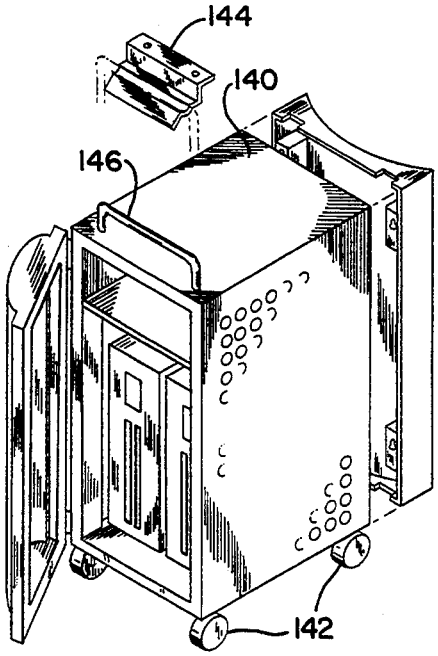
FIG. 18 is an isometric view of an electronic cart usable with a table of this invention.

An additional feature of the invention which is illustrated in FIG. 18 comprises an electronic cart 140 mounted on casters 142 which may be secured beneath a table top or bridge. One method of securing the cart 140 is by means of a bracket 144 screwed to the underside of the table top or bridge to engage a handle 146 on the top of the cart. In this manner the cart may be readily disengaged when desired so that it may be removed or replaced.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

I claim:

1. A table foldable between a storage configuration and a working configuration comprising:

a beam having first and second ends, normally horizontal when said table is in its working configuration;

first and second substantially identical leg members, each having a pedestal portion normally vertical when said table is in its working configuration, and a pair of spaced, parallel support arms extending horizontally from opposite ends of said pedestal portion;

means for pivotally securing each of said leg members to a different one of the first and second ends of said beam whereby said support arms are substantially aligned with said beam when the table is in its storage configuration and substantially perpendicular to said beam when the table is in its working configuration, the lowermost support arm of each leg member then functioning as a table leg; and a table top hingedly secured along the top of said beam for rotation between a folded position alongside said support arms when the table is in its storage configuration and a working position resting upon the uppermost support arm of each leg member when the table is in its working configuration.

2. The table of claim 1 wherein the pedestal portion of each leg member incorporates a first wiring channel therein.

3. The table of claim 2 wherein said pedestal portion includes a hinged door covering said first wiring channel.

4. The table of claim 1 including a latch between each of said uppermost support arms and said table top.

5. The table of claim 1 including a wire carrying trough selectively engageable with said beam to form a second wire channel therealong.

6. The table of claim 5 wherein said trough includes a hinged cover thereon.

7. The table of claim 1 including a gallery wire manager selectively attachable to, and extending along, said table top parallel to said beam to form a third wire channel.

8. The table of claim 7 wherein said gallery wire manager includes a shield panel hingedly secured thereto for rotation between a position closing said third wire channel and extending above said table top and an open position for access to said third wire channel.

9. The combination of first and second table tops, each having an edge supported by a substantially horizontal support arm, each of said arms and its top defining a space therebetween and the underside of each top carrying a latching member;

a planar bridge member intermediate and adjoining both of said edges to form an extension of said table tops, an underside of said bridge member carrying a latching member and a pair of socket members adjacent each such edge; and apparatus for selectively connecting adjoining edges of each table top and said bridge comprising:

an elongate body member;

means carried at each end of said body member for extending into both of said space and socket; and means carried by said body member for resiliently engaging the latching members of said table top and bridge member.

10. The combination of claim 8 further including a storage cart beneath either of said bridge or table top and means for releasably securing said cart thereto.

11. A table foldable between a storage configuration and a working configuration comprising:

a beam having first and second ends, normally horizontal when said table is in its working configuration;

first and second substantially identical leg members, each having a pedestal portion normally vertical when said table is in its working configuration, and a pair of spaced, parallel support arms extending horizontally from opposite ends of said pedestal portion;

means for pivotally securing each of said leg members to a different one of the first and second ends of said beam whereby said support arms are substantially aligned with said beam when the table is in its storage configuration and substantially perpendicular to said beam when the table is in its working configuration, the lowermost support arm of each leg member then functioning as a table leg;

a table top hingedly secured along the top of said beam for rotation between a folded position alongside said support arms when the table is in its storage configuration and a working position resting upon the uppermost support arm of each leg member when the table is in its working configuration;

first and second latch plates mounted on the underside of said table top, each defining a notch therein including a locking detent;

a spring loaded locking pawl carried by each of said uppermost support arms, each of said locking pawls being adapted to engage the locking detent of a different one of said first and second locking plates when the table is in its working configuration; and release means on each of said support arms for disengaging its respective locking pawl from its respective locking detent.

12. The table of claim 11 wherein said release means comprises a member rotatable about a substantially vertical axis to disengage said pawl and detent upon rotation in either direction about said axis.

* * * * *